US011183763B2

(12) United States Patent
Du

(10) Patent No.: US 11,183,763 B2
(45) Date of Patent: Nov. 23, 2021

(54) LOW PROFILE DUAL-BAND QUADRIFILAR ANTENNA

(71) Applicant: Atlanta RFtech LLC, Snellville, GA (US)

(72) Inventor: Xin Du, Schaumburg, IL (US)

(73) Assignee: ATLANTA RFTECH LLC, Snellville, GA (US)

( * ) Notice: Subject to any disclaimer, the term of this patent is extended or adjusted under 35 U.S.C. 154(b) by 19 days.

(21) Appl. No.: 16/731,242

(22) Filed: Dec. 31, 2019

(65) Prior Publication Data

US 2021/0203074 A1 Jul. 1, 2021

(51) Int. Cl.

| | |
|---|---|
| ***H01Q 11/08*** | (2006.01) |
| ***H01Q 9/04*** | (2006.01) |
| ***H01Q 1/36*** | (2006.01) |
| ***H01Q 1/48*** | (2006.01) |

(52) U.S. Cl.

CPC ..... *H01Q 9/04* (2013.01); *H01Q 1/36* (2013.01); *H01Q 1/48* (2013.01); *H01Q 9/0407* (2013.01)

(58) Field of Classification Search

CPC ..... H01Q 1/36; H01Q 1/48; H01Q 9/0407; H01Q 11/08

See application file for complete search history.

(56) References Cited

U.S. PATENT DOCUMENTS 5,170,176 A 12/1992 Yasunaga et al.
5,349,365 A 9/1994 Ow et al.
5,515,057 A 5/1996 Lennen et al.
5,678,201 A 10/1997 Thill
6,005,521 A * 12/1999 Suguro ..... H01Q 1/38 343/700 MS
6,118,406 A * 9/2000 Josypenko ..... H01Q 1/38 343/700 MS
6,150,981 A * 11/2000 Suguro ..... H01Q 1/362 343/700 MS
6,154,184 A * 11/2000 Endo ..... H01Q 1/10 343/702
6,653,987 B1 11/2003 Lamensdorf et al.
6,720,935 B2 4/2004 Lamensdorf et al.
7,436,363 B1 10/2008 Klein et al.
7,525,508 B2 4/2009 Sharaiha et al.
7,843,392 B2 11/2010 Munger et al.
8,618,998 B2 12/2013 Kikin
9,306,273 B2 4/2016 Leisten
(Continued)

OTHER PUBLICATIONS

Litsuka, Y. et al., "A low profile Quadrifiler Helix Antenna for Satellite Communication," IEEE AP-S 2002, pp. 728-730, IEEE Antennas and Propagation Society.

(Continued)

*Primary Examiner* — Hasan Islam
(74) *Attorney, Agent, or Firm* — Babcock IP, PLLC

(57) ABSTRACT

A hybrid antenna structure with a ground plane; a supporting body coupled to the ground plane. The supporting body provided with four helical filar extending from the ground plane, ends of each of the filar coupled at a connection point to a periphery of a patch. The filar each having a length of approximately ½ wavelength of a desired operating frequency. Further, the hybrid antenna structure may be configured for self-diplexing by adding a high-band patch upon the patch, spaced apart by a dielectric spacer.

18 Claims, 9 Drawing Sheets

(56) References Cited

U.S. PATENT DOCUMENTS

| | | | | |
|---|---|---|---|---|
| 9,614,293 | B2 | 4/2017 | Elliot et al. | |
| 9,905,932 | B2 | 2/2018 | Dinallo | |
| 10,199,733 | B1 | 2/2019 | Dinallo | |
| 2017/0062917 | A1* | 3/2017 | Hyjazie | H01Q 11/08 |
| 2020/0033436 | A1* | 1/2020 | Videtich | G01S 3/043 |

OTHER PUBLICATIONS

Tranquilla, James M. and Steven R. Best, "A Study of the Quadrifilar Helix Antenna for Global Positioning System (GPS) Applications," IEEE Transactions on Antennas and Propagation, vol. 38, No. 10, Oct. 1990, p. 1545.

C. Kilgus, "Shaped-conical radiation pattern performance of the backfire quadrifilar helix", IEEE Transactions on Antennas and Propagation (vol. 23, Issue: 3, May 1975).

C. Kilgus, "Resonant quadrifilar helix design", Microwave J., vol. 13-12, pp. 49-54, Dec. 1970.

C. Kilgus, "Resonant quadrifilar helix", IEEE Trans. Antennas and Propagation. (Communication), vol. AP-17, pp. 349-351, May 1969.

* cited by examiner

LOW PROFILE DUAL-BAND QUADRIFILAR ANTENNA

FIELD OF THE INVENTION

The present invention relates to a low profile dual-band antenna, and more particularly to a low profile helical quadrifilar antenna utilizing a ground plane and a patch that is coupled between each of the filar ends.

BACKGROUND

Global navigation satellite systems (GNSS), location and/or elevation indication systems originally designed for the military, are now used worldwide also by both industry and the general public. Examples of growing GNSS uses include: automobile and truck navigation, smartphones, autonomous driving, aviation, smart agriculture, asset/package tracking, surveying, construction, sports equipment, workforce management, high speed trains and unmanned aerial vehicles.

As the importance of reliable GNSS availability has increased, there are a growing number of GNSS systems worldwide such as GPS (U.S.), GLONASS (Russia), Galileo (Europe), and Beidou (China).

Global GNSS Signals are right-hand circular polarized operating on these frequencies (MHz):

| | | |
|---|---|---|
| (U.S.) GPS | L1 C/A | 1575.42 |
| | L2 C | 1227.6 |
| | L2 P | 1227.6 |
| | L5 | 1176.45 |
| (Russia) GLONASS | L1 C/A | 1598.0625-1609.3125 |
| | L2 C | 1242.9375-1251.6875 |
| | L2 P | 1242.9375-1251.6875 |
| | L3 OC | 1202.025 |
| (Europe) Galileo | E1 | 1575.42 |
| | E5a | 1176.45 |
| | E5b | 1207.14 |
| | E5 AltBOC | 1191.795 |
| | E6 | 1278.75 |
| (China) BeiDou | B1I | 1561.098 |
| | B2I | 1207.14 |
| | B3 | 1268.52 |
| | B1C | 1575.42 |
| | B2a | 1176.45 |
| NAVIC | L5 | 1176.45 |
| SBAS | L1 | 1575.42 |
| | L5 | 1176.45 |
| (Japan) QZSS | L1 C/A | 1575.42 |
| | L1 C | 1176.45 |
| | L1S | 1575.42 |
| | L2C | 1227.6 |
| | L5 | 1176.45 |
| | L6 | 1278.75 |

By receiving multiple bands at the same time, GNSS equipment can provide accuracy cross checks and failsafe redundancy to provide additional precision for critical GNSS applications and Real Time Kinematic (RTK).

Therefore, an antenna covering all the frequency bands is highly desirable. The design challenge is that the overall band from 1164-1610 MHz has a 32% Bandwidth. As frequencies between 1300 and 1525 MHz are not used for GNSS, many design efforts are focused on dual-band approaches. E.g. the whole spectrum is separated into a low band and a high band.

Low band: 1164-1300 MHz, 11% Bandwidth.

High band: 1525-1610 MHz, 5.4% Bandwidth.

Many forms of circularly polarized antennas are known. Patch antenna or microstrip antenna are cost and size efficient for use in the High band but typically require thick/heavy dielectric substrate when configured for the Low band, which increases costs and may limit bandwidth.

Another antenna configuration is the quadrifilar helix antenna (QHA), also known as the Kilgus coil, comprising a collection of cooperating phase quadrature fed helical filar elements. QHA offer advantages of being light in weight, good circular polarization quality and wide bandwidth.

In precision GNSS application such as survey and reference station etc., the stability of phase center is a critical design parameter for cm or mm level accuracy measurement. The phase center of an antenna is located at the center of curvature of the radiated equal phase surface for a given component of the far field pattern. Phase center variation will result in positional errors. There are many factors contributing to the degree of unwanted variation of phase center. For instance, reducing phase center variation may be accomplished by reducing the cross-polarization levels or improving the circularity of survey antennas.

As described in U.S. Pat. No. 5,515,057, a multiple feed characteristic can improve X-Y phase center stability. Multiple feed antennas may also provide better circular polarization than a single feed. For multi-feeding point, the main drawback is that the feeding network loss will increase, resulting in poor gain-to-noise-temperature (G/T). Therefore, the feeding points are normally not in excess of 4 in practical application. QHA is a naturally quad-feed antenna.

Prior QHA typically have a tall cylindrical profile characteristic, for example as demonstrated by U.S. Pat. No. 10,199,733. Where low profile QHA configurations have been developed, these are typically only single band solutions.

In many applications, especially precision GNSS survey antennas, dual band antennas may be collocated or "piggy-backed" to realize a self-diplexing antenna. In this case, each antenna can be optimized and the requirement for an input diplexing device is eliminated, which may lower the overall noise characteristic of the resulting antenna array.

Prior attempts to combine high and low band antennas together by stacking or embedding patches or microstrip antennas are well known. For example, it is known that a very thick lower element may be used for the low band (which is heavy) when bandwidth is required. In some cases, high dielectric constant ceramic material is used to shrink the size in a tradeoff with reduced bandwidth.

There are stacked QHA antennas as well. However, these have poor performance due to interaction between the QHA.

U.S. Pat. No. 6,720,935 discloses a Single and Dual-band Microstrip Antenna (MSA) "Patch"/Helix Antenna Array utilizing a high profile n/4 wavelength open end QHA. It is known that an open end leads to the highest voltage point so it is sensitive to adjacent objects. Therefore, the disclosed antenna has to use a separate ground plane with enough distance to decouple the two antennas, increasing the height of the resulting antenna.

Therefore, there is a need for antenna solutions which improve electrical performance in a compact configuration.

SUMMARY OF THE INVENTION

It is an object of the invention to realize a low profile and dual-band quadrifilar antenna.

It is an object of the invention to provide an above-mentioned antenna to cover all existing GNSS frequency.

It is an object of the invention to provide an antenna with a hybrid working mode.

Another object of the invention is to reduce overall cost by avoiding use of expensive substrate materials.

It is another object of the invention to provide a platform for multi-feed stacked antenna integration.

Still another object of the invention is to minimize the mutual coupling in a multi-feed stacked antenna.

These objects are fulfilled in the present invention with a low profile dual frequency band and circularly polarized quadrifilar antenna with:

1. A ground plane,

2. A ½ wavelength QHA antenna element on the ground plane, and

3. A top layer MSA patch directly connected with the ends of the QHA filar. The patch is also a current path for the QHA. The patch size is selected for high band TM11 mode.

4. The QHA is driven from the bottom, via four feeds of equal amplitude but having 0°, 90°, 180° and 270° phase differentials. Changing the impedance will shift the frequency and ratio of fh/fl.

5. Four slots on the top layer may be applied to cut the unwanted current flow, improving high band and low band efficiency.

6. The highest current point and lowest voltage point at the physical center provides a natural grounding so feed lines can be carried through without adverse impact of the antenna performance, thus it can be a platform for an MSA upon QHA stacked antenna configuration.

Similar to stacked MSA, an MSA of the high band is stacked onto the top of the preferred embodiment where the grounded top layer provides a ground plane for the stacked element. In this case the top element should not be resonant to the high band and the lower QHA only works for the single band: low band. Furthermore, as the QHA and MSA have different electromagnetic field distributions, the coupling is alleviated.

7. In a specific example, an MSA is on top of the QHA. It provides an alternative stacked microstrip antenna configuration with the traditional lower microstrip element being replaced by a low profile QHA.

A significant benefit of the lower QHA versus the microstrip antennas is that as bandwidth limiting heavy relative dielectric is not needed, surface waves on an otherwise thick MSA are mitigated.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION OF THE INVENTION

Figure 2:
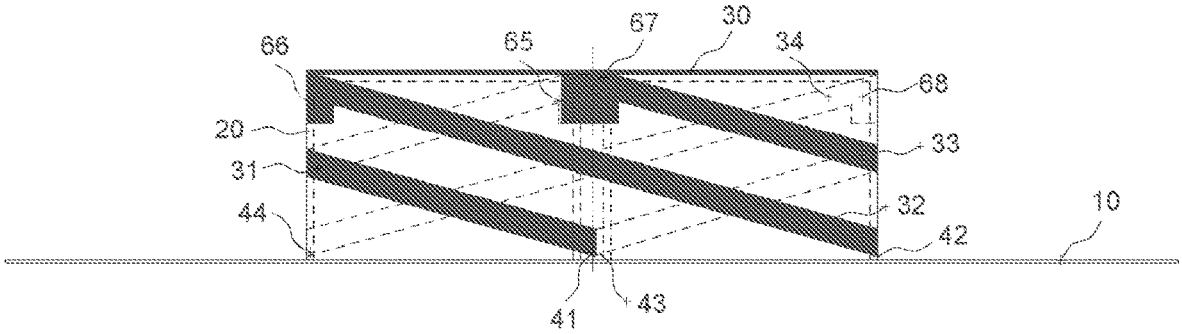
FIGS. 2 and 3 are respectively side and top views of the device of FIG. 1.
Figure 2A:
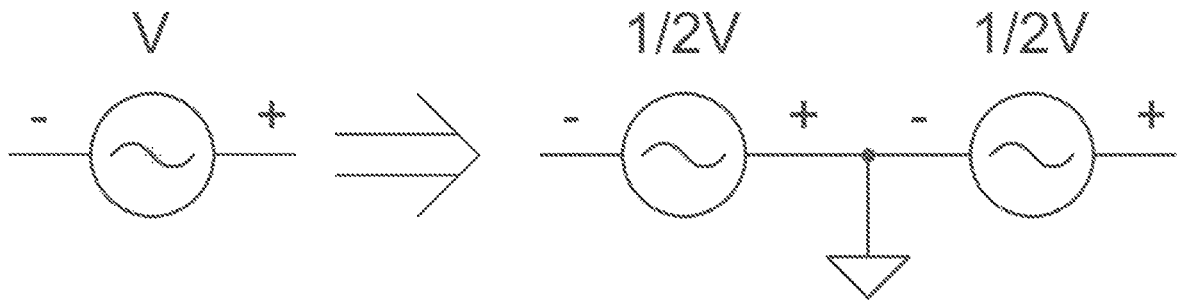
FIGS. 2A, 2B illustrate the feed and the interaction between the QHA current and TM11 circular patch mode.
Figure 2B:
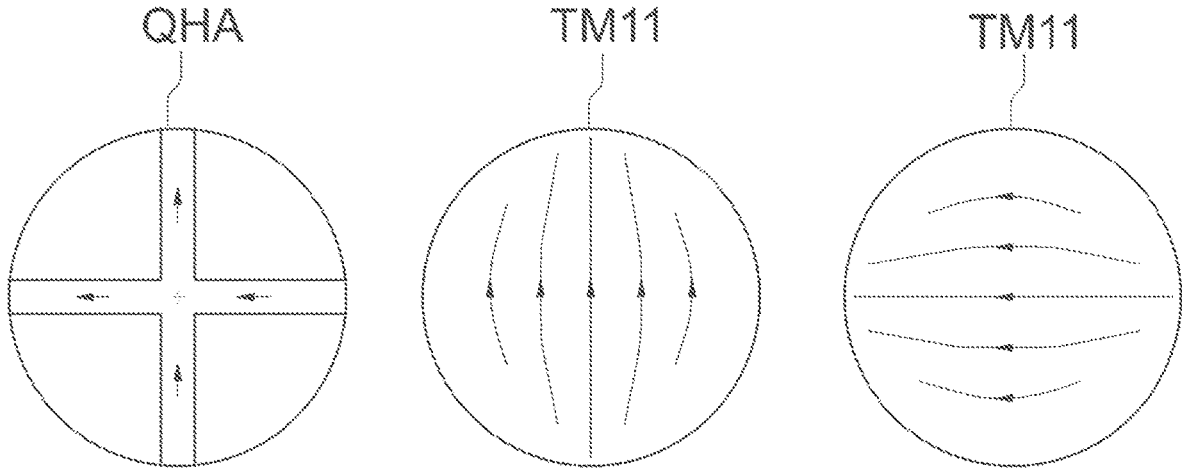

Referring to FIG. 2A, the original ½ wavelength Kilgus QHA is fed by 2 balun perpendicularly. Once a ground is used, the source can be decomposed to an unbalanced source. FIG. 2B shows the RF current flow of the original ½ wavelength Kilgus QHA and the current of the orthogonal TM11 mode of a circular MSA.

The inventor has recognized that where a % wavelength Kilgus QHA configuration is applied, the RF current flow and voltage is null at the centers of the filar. Therefore, one can fill this area with conductor without changing the working principle. Further, the MSA TM11 mode equivalent circuit is parallel to that in the QHAs.

One skilled in the art appreciates that more current path will be excited when the patch size is resonant to a certain frequency. In this case, the lower band will have the half-wave shorted QHA. This is because the feeding impedance near edge reaches the highest point so MSA TM11 mode is mismatched. In other words, the lower band has minimal MSA mode contribution.

Figure 1:
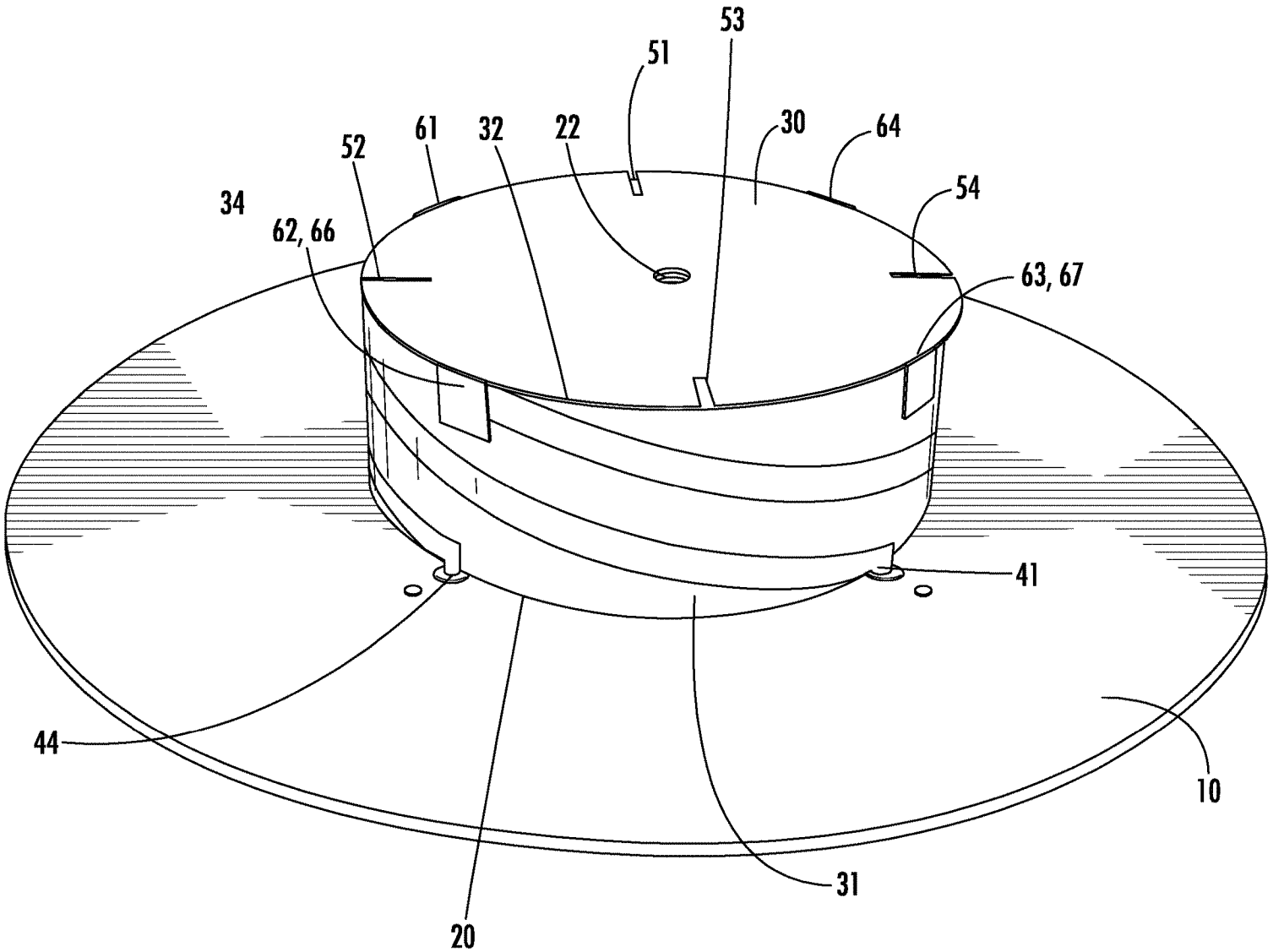
FIG. 1 is a perspective view of a circularly polarized first embodiment of the invention.
Figure 3:
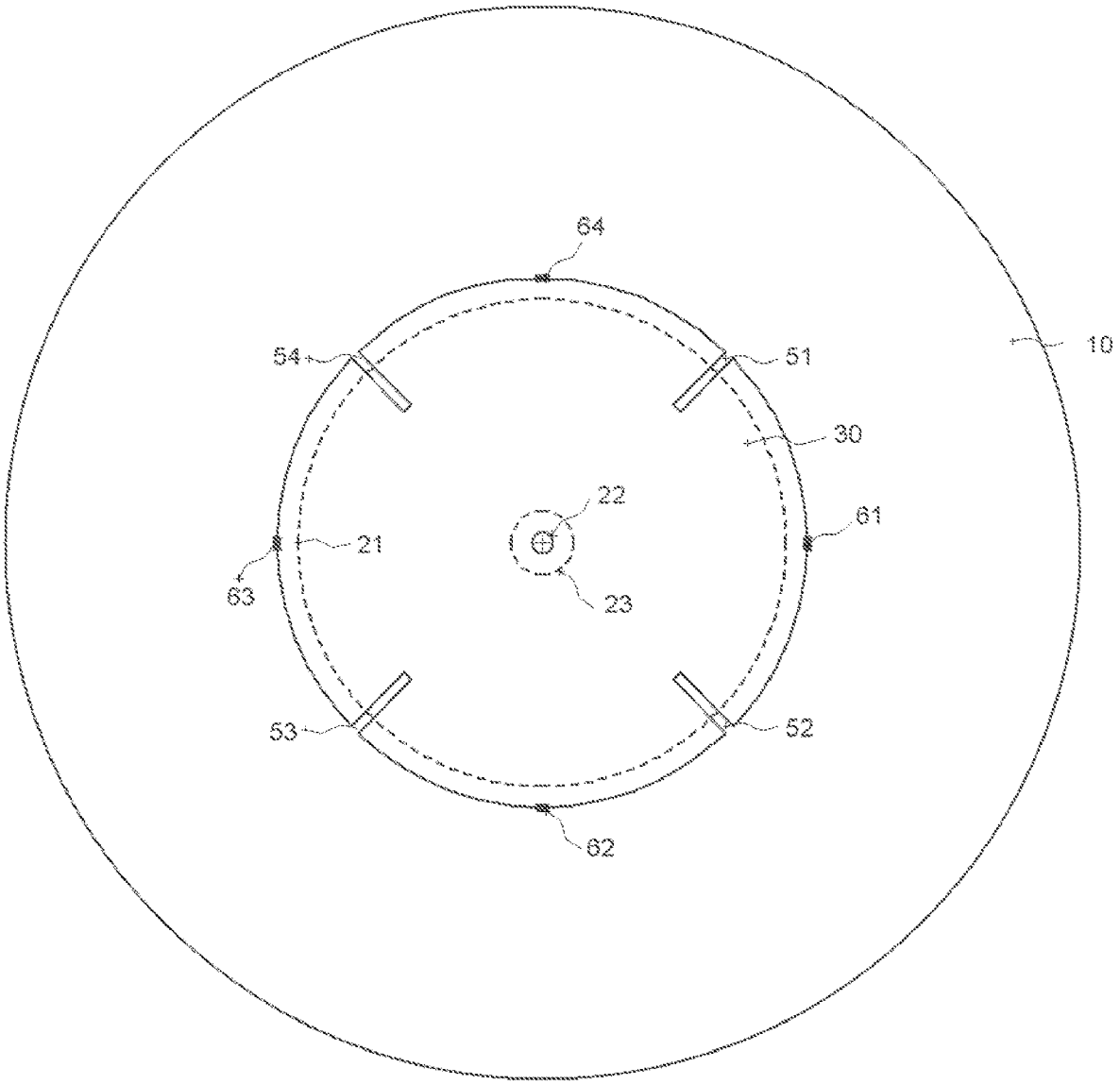

FIGS. 1, 2 and 3 demonstrate an exemplary embodiment of an improved GNSS dual band antenna comprising a ground plane seated ½ wavelength QHA with a mutual filar end patch.

A ground plane 10 is about 154 mm in diameter. Concentric with the ground plane 10, Helical QHA filar 31, 32, 33, and 34 may be provided as approximately 4 mm wide copper strips. The feeding points 41, 42, 43 and 44 at bottom of the respective filar, through the ground plane 10, may be driven by 0°, −90°, −180° and −270° phase differentials, respectively. The top layer is a deposited copper surface or copper planar patch 30, provided parallel to the ground plane 10, that is connected to the distal ends of the filar 31-34 where each intersects with a circumferential edge of the patch 30 at a connection point 61, 63, 63 and 64.

A supporting body 20 of the antenna may be provided as dielectric polymer operative as supporting structure and/or a conductor deposition surface for the filar 31-34 as well as the patch 30. Specific to this embodiment, only, a diameter of the supporting body 20 (and thus of the filar 31-34 arrayed upon it) is 70 mm and the height is 25.8 mm. The filar 31-34 have a width of 4 mm. Alternatively, the patch 30 and filar 31-34 may be applied as portions of flexible printed circuit boards (PCB), attached, for example, via adhesive and/or double side tape or the like. For cost efficiency and/or precision, the supporting body 20 may be formed via injection molding.

For additional tuning, the distal ends of the filar 31-34 may be provided with corresponding enlarged impedance matching pads 65, 66, 67 and 68 that then couple with the patch 30.

As best shown in FIG. 2, to reduce the overall height of the resulting antenna, the filar 31-34 may be provided at a helical angle with respect to the ground plane 10 of 20 degrees or less, or more specifically 13 degrees or less, here demonstrated as 12.56 degrees. In this embodiment, each filar 31-34, is positioned 90 degrees from adjacent filar 31-34 and transitions 180 degrees around the supporting body 20 between the respective feed and connection points 41-44, 61-64.

FIG. 3 provides further details of the patch 30. Connection points 61-64 couple the patch 30 and the respective filar 31-34. One skilled in the art will appreciate that the calculation of TM11 resonant frequency via dimensional selection is well known via reference and/or Personal Computer Aided Antenna Design (PCAAD) software. For example, for a mid-band frequency of 1583 MHz, the patch 20 diameter required in air dielectric is approximately 84 mm. The cavity model is valid for thickness less than 0.1 wavelengths so less accuracy will be expected when it is thicker. Patch 30 diameter is about 70 millimeters in the preferred embodiment due to the partial dielectric loading by the supporting body 20, including stand 23.

Although the low band is more detuned for MSA mode as previously discussed, the circular patch 30 does provide a path for the adjacent connection point, leading to higher loss of the antenna. A slot 51, 52, 53, 54 extending radial inward from the patch 30 periphery, positioned in between each of the adjacent connection points 61-64 may be applied to reduce these harmful currents. These slots 51-54 may be provided, for example, equidistant between adjacent connection points 61-64 about 2 mm in width and 7 mm in length.

The supporting body 20 is provided with, for example, an about 3 mm wall thickness 21. Similarly, a plated through hollow 22 provides a stand 23 to structurally reinforce the center of the patch 30, and also operate as a mounting point for the antenna (and/or a feed pathway in further embodiments).

Figure 4:
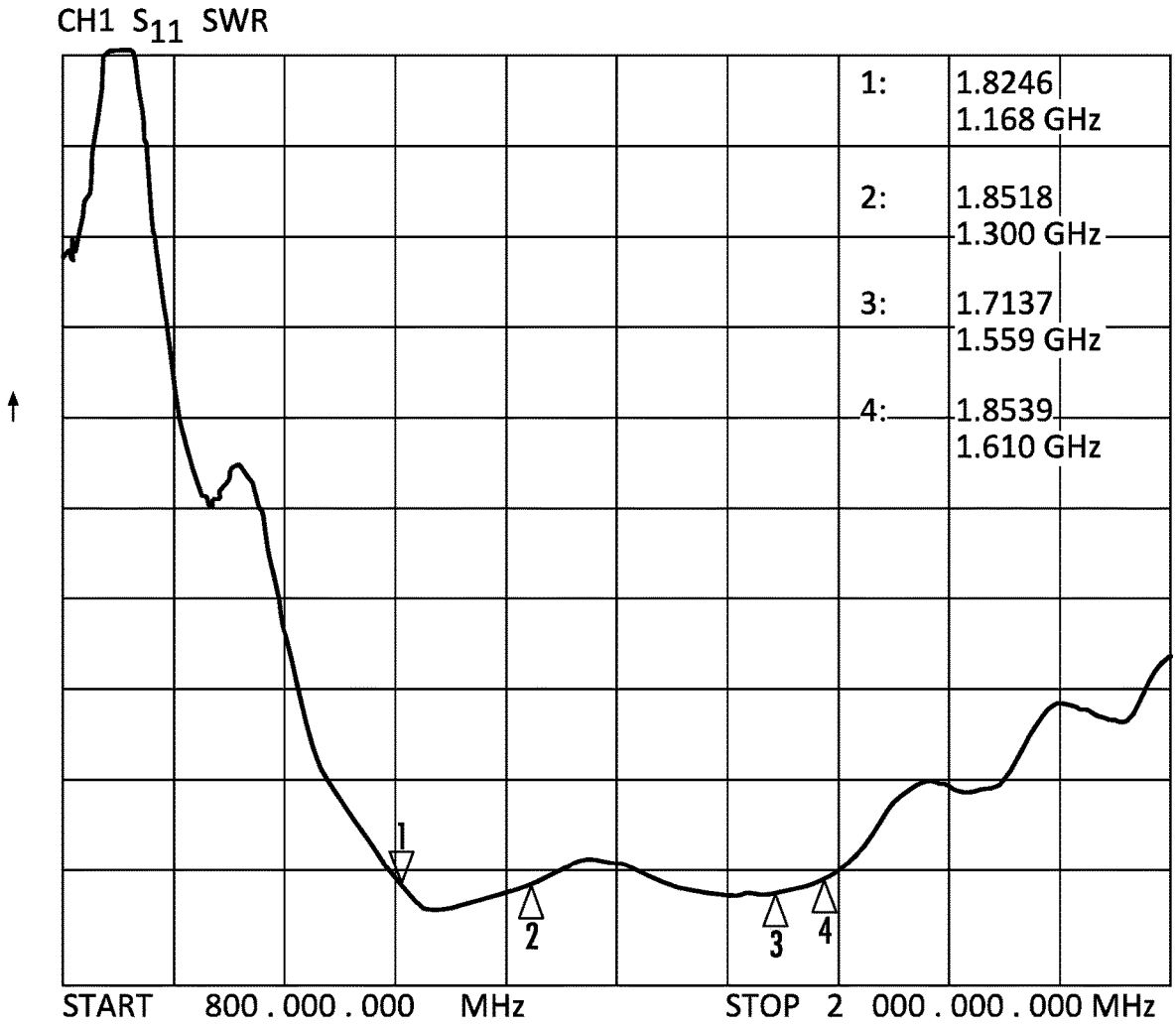
FIG. 4 demonstrates Return loss of the first exemplary embodiment.

FIG. 4 shows the return loss test result with VNA (Vector Network Analyzer), demonstrating dual band (Low and High GNSS Bands) operability.

Figure 7:
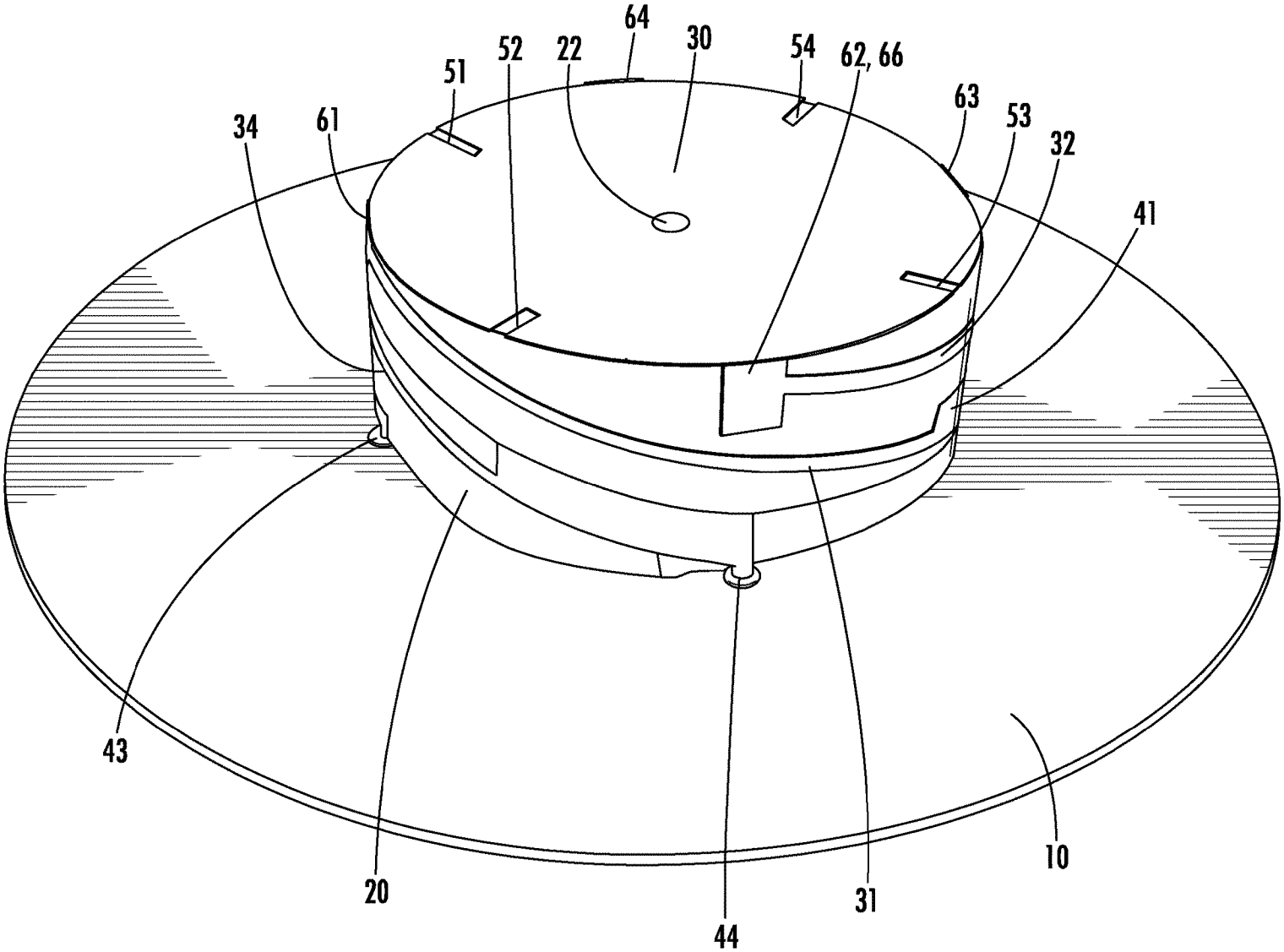
FIG. 7 and FIG. 8 are perspective and side views of a circularly polarized third embodiment of the invention.
Figure 8:
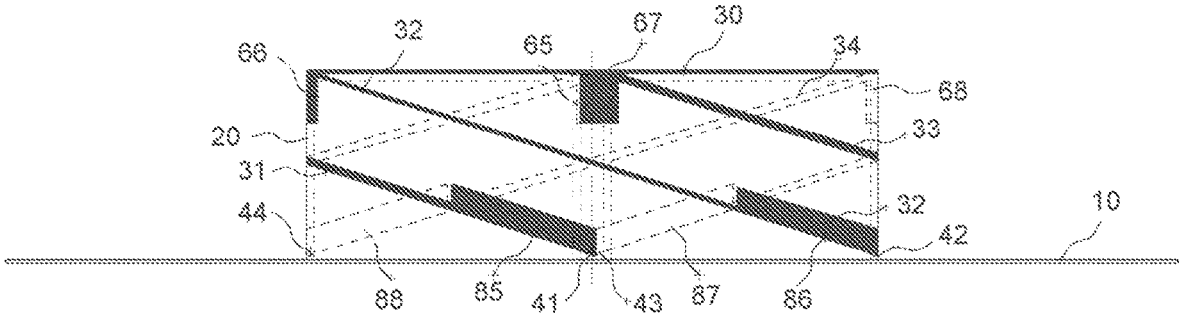

Further tuning of the filar 31-34 may be applied, as shown for example in FIGS. 7 and 8, via application of respective tuning sections 85, 86, 87 and 88 of increased filar width, here demonstrated as 6 mm wide×31 mm long, proximate the proximal end of each filar 31-34, while the remainder of the filar is 2.2 mm.

Where the additional hardware costs and electrical losses of diplexing the antenna feeds between the high and low bands are undesired, the antenna may be provided in a self-diplexing dual antenna/feed embodiment.

Figure 5:
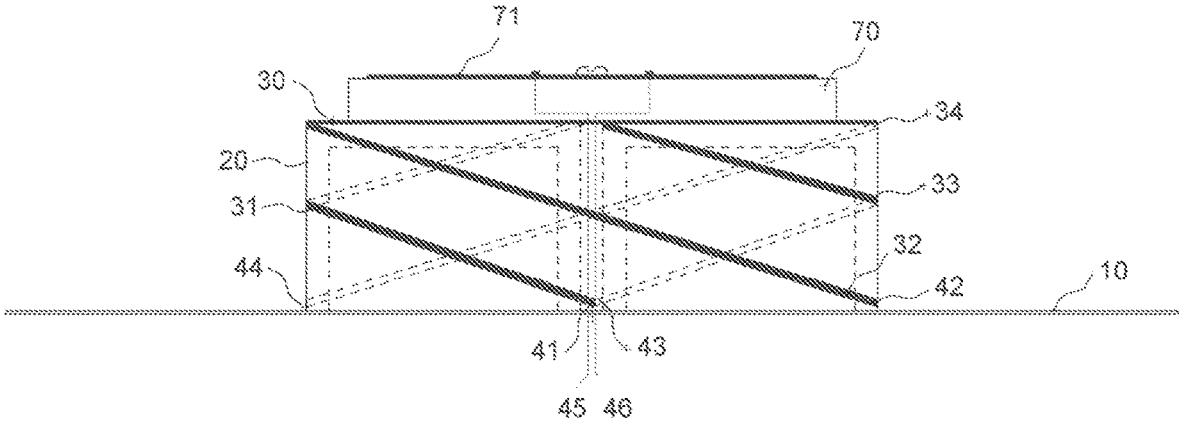
FIG. 5 and FIG. 6 are side and top views of a self-diplexing stacked antenna second embodiment of the invention.
Figure 6:
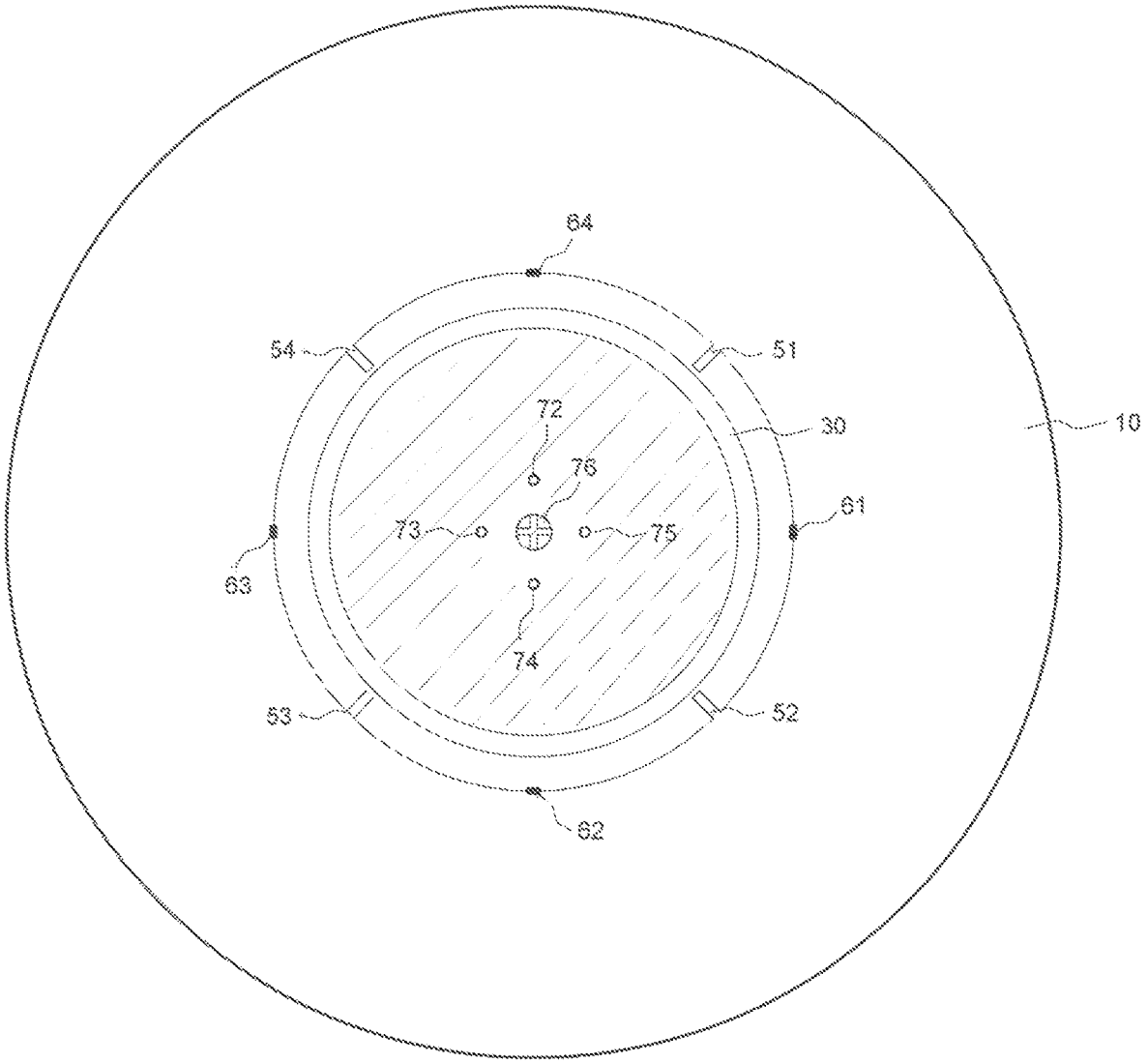

FIGS. 5 and 6 demonstrate a self-diplexing embodiment with separate low and high band feeds. Again, the supporting body 20 can be molded polymer with, for example, wrapped polyimide flexible PCB where etched conductor patterns form the filar 31-34. Patch 30 on the top may be, for example, metalized with a center conductive via to the ground plane 10, through the stand 23. A high band patch 71 is mounted upon the patch 30, wherefor the patch 30 is operative essentially as the ground plane of the high band patch 71, spaced apart by a dielectric spacer 70. The high band patch 71 covers the high band or some portion of the high band, depending upon the desired application.

In the preferred embodiment, the filar 31-34 may be tuned toward the low band as the high band is now served by the high band patch 71 assembly. Furthermore, it is possible to avoid configurations generating resonance with respect to the high band patch 71, for example by applying a narrower thickness of approximately 1.5 mm to the width of the traces of the filar 31-34. It is found that the dual band resonant behavior will be shifted and changed to single band when moving the feed points simultaneously to make the electrical path less than ½ wavelength of the lower frequency band.

The high band patch 71 may be dual feed or multi-feed depending on desired application. For instance, a quad feed may be applied for high precision survey applications. Typically, the feed lines are probes and can be fed through the stand 23. There is no coupling on the feed line since the plated stand 23 completely shields the feeds. Feeds 41, 43 can be connected to the phasing network or to a low noise amplifier (LNA). Here only two leads are illustrated for clarity but one skilled in the art appreciates that the number of feeds is not limited to two.

It is observed that the edge provide a patch to couple the adjacent port. Quad-feed MSA probes 72, 73, 74 and 75 couple the high band patch 71 to the respective feeds. Isolation may be improved by rotating the feeds 45 degrees, with respect to the phase differentials assigned to the filar feeding points 41-44. A coupler 76, such as a mounting screw or the like may be applied to secure the assembly as well as provide an additional grounding path for the high band patch 71.

In further embodiments, the supporting body 20 and thus the filar 31-34 may be provided in other than cylindrical configurations, for example with octagonal or square cross-sections. Notably, non-circular cross-sections enable multiple antenna assemblies to be provided each in closer proximity to one another in compact antenna arrays where multiple antenna elements are provided, for example with each optimized for a specific frequency band.

The embodiments of the present invention relate generally to a novel design for a low profile, dual-band, quadrifilar helix antenna structure. While the preferred embodiments represent implementations optimized for GNSS survey application, the design may be equally applied to other applications where a more compact, dual band antenna is desirable when higher dielectric constant material loading is applied.

Table of Parts

| | |
|---|---|
| 10 | Ground plane |
| 20 | Supporting body |
| 21 | Wall thickness |
| 22 | Hollow |
| 23 | Stand |
| 30 | Patch |
| 31 | filar |
| 32 | filar |
| 33 | filar |
| 34 | filar |
| 41 | Feeding point |
| 42 | Feeding point |
| 43 | Feeding point |
| 44 | Feeding point |
| 51 | Slot |
| 52 | Slot |
| 53 | Slot |
| 54 | Slot |
| 61 | Connection point |
| 62 | Connection point |
| 63 | Connection point |
| 64 | Connection point |
| 65 | Impedance matching pad |
| 66 | Impedance matching pad |
| 67 | Impedance matching pad |
| 68 | Impedance matching pad |
| 70 | Dielectric spacer |
| 71 | High-band patch |
| 72 | Quad-feed MSA probe |
| 73 | Quad-feed MSA probe |
| 74 | Quad-feed MSA probe |
| 75 | Quad-feed MSA probe |
| 76 | Coupler |
| 85 | Tuning section |
| 86 | Tuning section |
| 87 | Tuning section |
| 88 | Tuning section |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A hybrid antenna structure, comprising:

a ground plane;

a supporting body coupled to the ground plane;

the supporting body provided with four helical filar extending from the ground plane, a distal end of each of the four helical filar coupled at a respective connection point to a periphery of a patch parallel to the ground plane;

the patch provided with a plurality of slots extending radially inward from the periphery of the patch, one of the slots positioned in between each of the respective connection points which are adjacent to one another;

the four helical filar each having a length of ½ wavelength of a desired operating frequency.

2. The hybrid antenna structure of claim 1, wherein the ground plane, supporting body and patch are circular and concentric.

3. The hybrid antenna structure of claim 1, wherein each of the four helical filar pass through the ground plane to a respective feeding point, each of the respective feeding points and each of the respective connection points provided arrayed in a circular pattern spaced 90 degrees apart, respectively.

4. The hybrid antenna structure of claim 3, wherein the feeding point and the connection point for each of the four helical filar are 180 degrees apart.

5. The hybrid antenna structure of claim 1, wherein the four helical filar have an increased width impedance matching pad at the distal end.

6. The hybrid antenna structure of claim 1, wherein the four helical filar respectively have an increased width tuning section extending from a proximal end.

7. The hybrid antenna structure of claim 1, further including a high-band patch positioned upon the patch, spaced away from the patch by a dielectric spacer.

8. The hybrid antenna structure of claim 7, wherein the supporting body has a hollow stand proximate a center axis of the supporting body, the stand extending between the patch and the ground plane.

9. The hybrid antenna structure of claim 8, wherein at least one microstrip antenna probe extends from the high band patch through the ground plane.

10. The hybrid antenna structure of claim 1, wherein a width of the supporting body is greater than a height of the supporting body.

11. A hybrid antenna structure, comprising:

a ground plane;

a supporting body coupled to the ground plane;

the supporting body provided with four helical filar extending from the ground plane, ends of each of the four helical filar coupled at a respective connection point to a periphery of a planar patch;

the planar patch is provided with a plurality of slots extending radially inward from the periphery of the planar patch, one of the slots positioned in between each of the adjacent connection points;

a high-band patch positioned upon the planar patch, spaced away from the planar patch by a dielectric spacer;

the four helical filar each having a length of ½ wavelength of a desired operating frequency.

12. The hybrid antenna structure of claim 11, wherein the ground plane, supporting body and planar patch are circular and concentric.

13. The hybrid antenna structure of claim 11, wherein each of the four helical filar pass through the ground plane to a respective feeding point, each of the respective feeding points and each of the respective connection points provided arrayed in a circular pattern spaced 90 degrees apart, respectively.

14. The hybrid antenna structure of claim 13, wherein the feeding point and connection point for each of the four helical filar are 180 degrees apart.

15. The hybrid antenna structure of claim 11, wherein the four helical filar have a width of 1.5 mm or less.

16. The hybrid antenna structure of claim 11, wherein the supporting body has a hollow stand proximate a center axis of the supporting body, the stand extending between the planar patch and the ground plane.

17. The hybrid antenna structure of claim 16, wherein at least one microstrip antenna probe extends from the high-band patch through the ground plane.

18. The hybrid antenna structure of claim 17, wherein the at least one microstrip antenna probe extends through the stand.

* * * * *